US005458383A

United States Patent [19]

Gunn

[11] Patent Number: 5,458,383

[45] Date of Patent: Oct. 17, 1995

[54] DOOR SECURITY SYSTEM

[75] Inventor: William R. Gunn, 30990 Stone Ridge Dr., Apt. #10207, Wixom, Mich. 48393

[73] Assignee: William R. Gunn, Wixom, Mich.

[21] Appl. No.: 267,441

[22] Filed: Jun. 27, 1994

[51] Int. Cl.[6] ..... E05C 1/04

[52] U.S. Cl. ..... 292/148

[58] Field of Search ..... 292/148, 151, 292/292, 295, 302

[56] References Cited

U.S. PATENT DOCUMENTS

| | | | |
|---|---|---|---|
| 611,676 | 10/1898 | Cave | 292/DIG. 15 X |
| 1,723,007 | 8/1929 | Bittorf | 292/DIG. 15 X |
| 2,131,415 | 9/1938 | Woodward | 268/30 |
| 2,789,636 | 4/1957 | Lawick | 160/188 |
| 2,973,561 | 3/1961 | Jackson | 20/16 |
| 3,075,376 | 1/1963 | Christiansen | 70/95 |
| 3,163,033 | 12/1964 | Boyles | 70/100 |
| 3,199,153 | 8/1965 | Weinstein | 20/16 |
| 3,334,933 | 8/1967 | Ehlers | 292/148 |
| 3,961,816 | 6/1976 | Mueller | 292/148 |
| 4,095,828 | 6/1978 | East | 292/148 |
| 4,185,860 | 1/1980 | Bondi | 292/148 |
| 4,512,597 | 4/1985 | Nabb et al. | 292/143 |
| 4,601,502 | 7/1986 | Van Dyke | 292/252 |
| 4,861,079 | 8/1989 | DeForrest, Sr. | 292/148 |
| 4,867,496 | 9/1989 | Thomas | 292/341.16 |
| 4,877,275 | 10/1989 | DeForrest, Sr. | 292/148 |
| 4,911,486 | 3/1990 | Anderson | 292/148 |

*Primary Examiner*—Peter M. Cuomo
*Assistant Examiner*—Monica E. Millner
*Attorney, Agent, or Firm*—Gifford, Krass, Groh, Sprinkle, Patmore, Anderson & Citkowski

[57] ABSTRACT

A security system is provided for use in conjunction with a door, such as a garage door, having an opening extending upwardly from a ground surface as well as a garage door which is pivotal around a horizontal axis between an open and a closed position. The security system includes a housing having a back wall, a top wall and a bottom wall. The back wall is secured to the garage door. A strike plate is then mounted in the ground beneath the housing and registering apertures are formed through the housing top wall, bottom wall and strike plate. An elongated rod is slidably and removably positioned through the registering apertures in the housing and the strike plate, so that, with a portion of the rod positioned within each aperture, the rod prevents opening of the garage door. A padlock is secured to the rod between the housing top and bottom wall in order to removably secure the rod in place to the housing.

4 Claims, 1 Drawing Sheet

DOOR SECURITY SYSTEM

BACKGROUND OF THE INVENTION

1. Field of the Invention

The present invention relates to a security lock for a garage door.

2. Description of the Prior Art

Many valuables, such as bicycles, cars, lawn equipment and the like, are stored in the garage of people's homes. Furthermore, the garage is often times subjected to break-ins and theft in part because the garage is separated from the living quarters of the home.

In order to discourage theft from the garage, most garages have garage doors which can be selectively locked in a closed position. For example, in one type of garage door lock, a handle is rotatable between 90° positions. In one position, the handle actuates locking bars which engage the garage door rails in order to lock the garage door in a closed position. Conversely, rotation of a handle by 90° retracts the locking bars from the garage door rails and allows the garage door to be opened.

These previously known garage door locks, however, have not proven entirely satisfactory in use. One disadvantage of these previously known garage door locks is that the locks are relatively lightweight in construction. As such, thieves can easily break the lock handle from the garage door, unlock the garage door lock and open the garage door.

SUMMARY OF THE PRESENT INVENTION

The present invention provides a security system for a door, especially a garage door, which overcomes all of the above-mentioned disadvantages of the previously known devices.

In brief, the security system of the present invention comprises a housing having a back wall, top wall, and a bottom wall so that the top and bottom walls are spaced apart and substantially parallel to each other. The back wall, in turn, is taxably secured to the garage door by threaded fasteners.

A strike plate is then mounted in the driveway beneath the housing. The housing top wall, bottom wall and strike plate each contain an aperture such that the apertures register with each other. A hole is also formed in the driveway beneath the strike plate aperture.

An elongated rod is then slidably and removably positioned in the registering apertures in the housing and strike plate so that a portion of the rod is positioned through each of the three apertures. In doing so, the elongated rod prevents opening of the garage door.

The rod is also selectively locked to the housing by a padlock which is positioned between the top and bottom walls of the housing. Additionally, the housing preferably includes side walls in order to protect both the padlock as well as the rod from sawing or other physical attack.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 1:
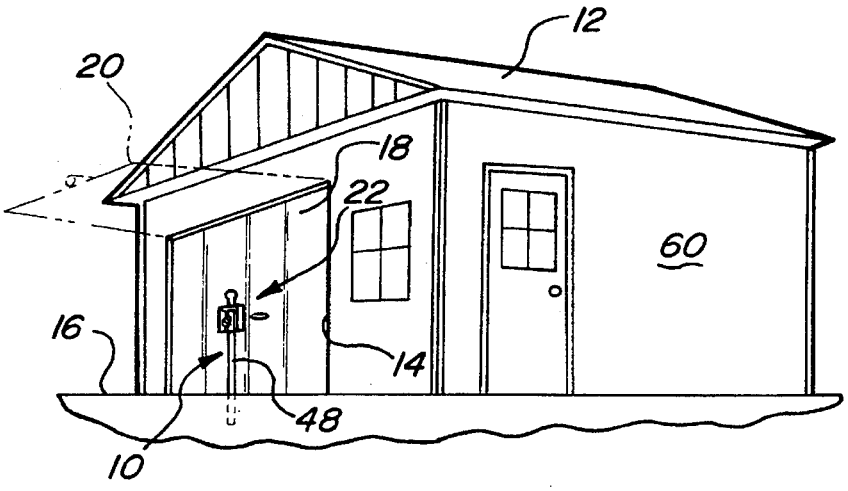
FIG. 1 is an elevational view illustrating a preferred embodiment of the present invention installed on a garage door.

With reference first to FIG. 1, a preferred embodiment of the security system 10 of the present invention is there shown for use with a garage 12 having a garage door opening 14. The garage door opening 14 extends upwardly from a ground surface or driveway 16.

A garage door 18 is pivotly mounted to the garage 12 so that the garage door 18 is movable between a closed position, illustrated in FIG. 1, and an open position in which access to the interior of the garage is provided through the doorway 14. Furthermore, as shown in FIG. 1, the garage door 18 is pivotal about a horizontal axis 20.

Figure 2:
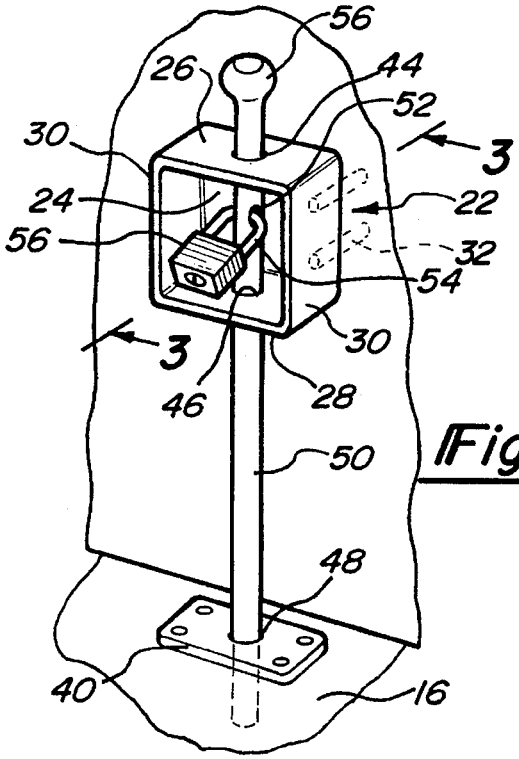
FIG. 2 is a front plan view illustrating the preferred embodiment of the present invention.
Figure 3:
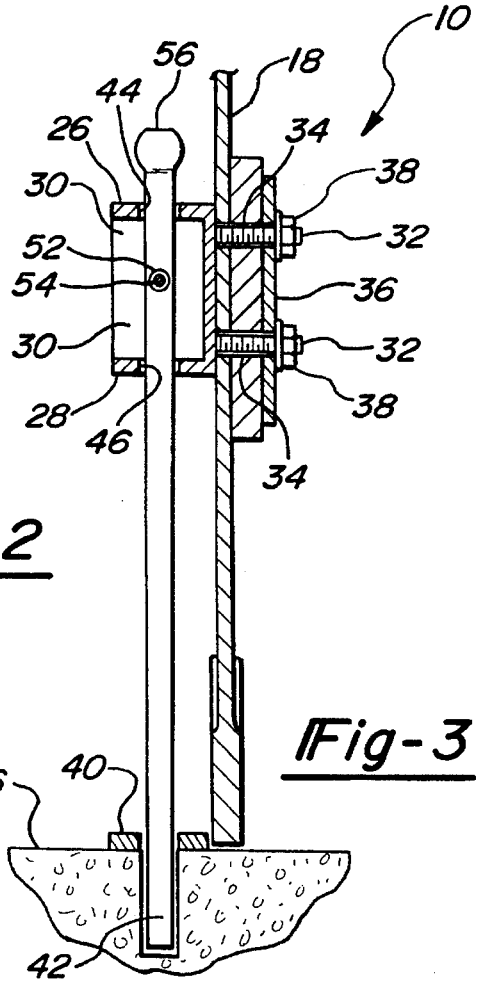
FIG. 3 is a cross sectional view of the present invention taken substantially along line 3—3 in FIG. 2.

With reference now especially to FIGS. 2 and 3, the security system 10 is there shown in greater detail and comprises a generally rectangular housing 22. The housing 22 includes a back wall 24, top wall 26 and bottom wall 28. The top wall 26 and bottom wall 28 are generally spaced apart and parallel to each other. The housing 22 is also preferably constructed of forged steel for high strength.

In the preferred embodiment of the invention, the housing 22 also preferably includes a pair of side walls 30 which extends between the ends of the top wall 26 and bottom wall 28 so that the housing 22 is open only on its front.

A plurality of spaced threaded fasteners 32 are secured to and extend laterally outwardly from the rear of the housing back wall 24. Preferably, the threaded fasteners 32 are fixably secured to the housing 22 by welding.

Figure 4:
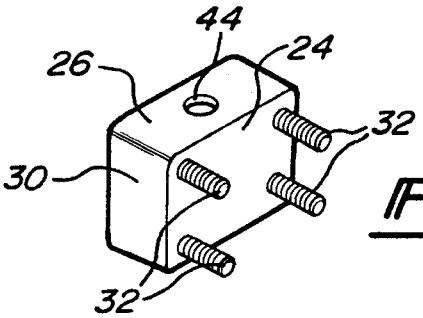
FIG. 4 is a rear elevational view showing a portion of the preferred embodiment of the invention.

As best shown in FIGS. 3 and 4, the threaded fasteners 32 extend through openings 34 in the garage door 18 and through registering openings in a generally rectangular back reinforcing plate 36. The back plate 36 is positioned on the inside of the garage door 18 so that the garage door 18 is sandwiched between the housing back wall 24 and back plate 36. The housing 22 is then secured to the garage door 18 by nuts 38 thereby firmly securing the housing 22 to the garage door 18.

Referring again to FIGS. 1 and 2, a generally rectangular strike plate 40 is secured to the ground surface or driveway 16 beneath the housing 22. As there shown in FIG. 3, a hole 42 is also formed in the ground surface 16 beneath the strike plate 40.

Registering apertures 44, 46 and 48 are then respectively provided through the housing top wall 26, bottom wall 28 and strike plate 48. An elongated rod 50 is then slidably positioned through the registering apertures 44, 46, and 48 to the position shown in solid line in FIG. 2. In doing so, a portion of the rod is positioned through each of the apertures 44, 46 and 48 which prevent pivoting of the garage door 18 to its open position and, in doing so, secures the garage door 18 in its closed position.

Referring now especially to FIG. 2, in order to secure the rod 50 in its locked position, i.e. with the rod 50 positioned through each aperture 44, 46 and 48, the rod 50 includes a transverse throughbore 52 which is positioned between the housing top wall 26 and bottom wall 28. A keeper portion 54 of a padlock 56 is then positioned through the bore 52 and the rod 50 in order to secure the rod 50 to the housing 22 and insure that at least a portion of the rod 50 remains in each of the apertures 44, 46 and 48.

With reference again to FIGS. 2 and 3, the rod 50 preferably includes a handle 56 at its upper end. The handle 56 is preferably circular in cross sectional shape and has a cross sectional area larger than the aperture 44 and the housing top wall 26. As such, the handle 56 prevents the rod 50 from falling downwardly from the housing 22 and into the hole 42 formed in the driveway 16.

In order to open the garage door 18, the padlock 56 is removed from the rod 50. The rod 50 is then lifted by its handle 56. In doing so, the rod 50 is lifted out of the aperture 48 formed through the strike plate 50 which prevents the garage door 18 from pivoting to its open position.

In order to enhance the security for the garage door 18, preferably the strike plate 40, rod 50 and housing 22 are constructed of a hard material, such as steel. Furthermore, the provision of the back plate 36 further enhances the strength of the attachment between the housing 22 and the garage door 18 and thus enhances the overall strength of the security system 10.

As described thus far, the security system 10 of the present invention is intended for use with a garage door of the type that pivots about an upper horizontal axis. Other types of garage doors, however, slide vertically upwardly on rails from a closed position to an open position. In this case, the housing 22 is simply rotated 90° and the strike plate 40 is secured along one side wall 60 (FIG. 1) of the garage. In all other respects, the security system 10 will remain identical and will not be described again.

Although the security device of the present invention has been described for use with a garage door, it will be understood that the security device can be used with any type of door.

Having described my invention, however, many modifications thereto will become apparent to those skilled in the art to which it pertains without deviation from the spirit of the invention as defined by the scope of the appended claims.

I claim:

1. For use in conjunction with a building structure having an opening extending upwardly from a ground surface, a security system for a door of the type pivotal about a horizontal axis between a closed position in which the door covers the opening and an open position in which the door uncovers the opening to enable access to an interior of the building structure, said security system comprising:

a housing having a back wall, a top wall, a bottom wall and two spaced apart side walls, said top wall and bottom wall being spaced apart and substantially parallel to each other, and each side wall extending between said top wall and said bottom wall so that only a front of said housing is open, means for fixedly securing said back wall to the door, a strike plate mounted to the ground surface beneath said housing, said top wall, said bottom wall and said strike plate each having an aperture formed therethrough so that said apertures in said top wall, said bottom wall and said strike plate register with each other, an elongated rod slidably and removably positioned in said apertures in said top wall, said bottom wall and said strike plate, said rod having a traverse through bore positioned between said housing top wall, bottom wall and side walls when said rod is positioned in said strike plate, and means for selectively locking said rod to said housing so that a portion of said rod is entrapped within each aperture in each of said top wall, said bottom wall and said strike plate, said locking means comprising a padlock, whereby said padlock is accessible only through said open front of said housing.

2. The invention as defined in claim 1 and comprising a handle on one end of said rod, said handle having a cross sectional area larger than the cross sectional area of said aperture in said top wall.

3. The invention as defined in claim 2 wherein said handle is circular in cross sectional shape.

4. The invention as defined in claim 1 wherein said fixedly securing means comprises a plurality of threaded fasteners extending outwardly from said back wall, said fasteners extending through openings formed through the door, a back plate having holes which register with said threaded fasteners, the door being sandwiched between said back wall and said back plate, and nuts which threadably engage said threaded fasteners.

* * * * *